US009631484B2

(12) United States Patent
Rozenblit et al.

(10) Patent No.: US 9,631,484 B2
(45) Date of Patent: Apr. 25, 2017

(54) DRILLING SYSTEM HAVING A SUPER-CAPACITOR AMPLIFIER AND A METHOD FOR TRANSMITTING SIGNALS

(71) Applicants: Vladimir Rozenblit, Houston, TX (US); Vadim Buryakovsky, Houston, TX (US); Lawrence Chang-Yung Wang, Mountain View, CA (US); Yevgeniy Filipp Fiterman, Houston, TX (US)

(72) Inventors: Vladimir Rozenblit, Houston, TX (US); Vadim Buryakovsky, Houston, TX (US); Lawrence Chang-Yung Wang, Mountain View, CA (US); Yevgeniy Filipp Fiterman, Houston, TX (US)

(73) Assignee: R&B Industrial Supply Co., Houston, TX (US)

( * ) Notice: Subject to any disclaimer, the term of this patent is extended or adjusted under 35 U.S.C. 154(b) by 938 days.

(21) Appl. No.: 13/769,328

(22) Filed: Feb. 17, 2013

(65) Prior Publication Data

US 2014/0231139 A1 Aug. 21, 2014

(51) Int. Cl.
*E21B 47/12* (2012.01)

(52) U.S. Cl.
CPC ..... *E21B 47/121* (2013.01); *E21B 47/122* (2013.01)

(58) Field of Classification Search
CPC ..... E21B 47/121; E21B 47/122
See application file for complete search history.

(56) References Cited

U.S. PATENT DOCUMENTS 5,160,925 A * 11/1992 Dailey ..... E21B 47/011 175/40
2006/0221516 A1* 10/2006 Daboussi ..... H02J 7/0016 361/18
2007/0258188 A1* 11/2007 Shiue ..... B60K 6/28 361/266
2012/0268074 A1* 10/2012 Cooley ..... H01G 11/58 320/130
2013/0026978 A1* 1/2013 Cooley ..... H01M 10/052 320/107
2013/0271066 A1* 10/2013 Signorelli ..... H02J 7/0042 320/107

* cited by examiner

*Primary Examiner* — Elizabeth Gitlin
(74) *Attorney, Agent, or Firm* — Reches Patents

(57) ABSTRACT

A drilling system that may include a drilling element for drilling a hole in a geological formation; a sensor module arranged to collect information about the drilling; a transmitter that is arranged to receive the information from the sensor module, amplify the information by a super-capacitor amplifier to provide amplified information and to provide the amplified information to a first element and to a second element of an antenna, the first and second elements of the antenna are located at two opposite sides of a band gap; wherein the antenna is arranged to transmit the amplified information via the geological formation; wherein the super-capacitor amplifier comprises a plurality of switched capacitor converters, each switched capacitor converter comprises a plurality of converter stages, each converter stage comprises capacitors and switches that are arranged to perform a current amplification of an input signal; wherein each converter stage is arranged to operate with alternating charge cycles and discharge cycles.

24 Claims, 7 Drawing Sheets

1000

DRILLING SYSTEM HAVING A SUPER-CAPACITOR AMPLIFIER AND A METHOD FOR TRANSMITTING SIGNALS

FIELD OF THE INVENTION

Drilling systems and especially drilling systems having telemetry modules for underground drilling such as oil field applications.

BACKGROUND OF THE INVENTION

An underground drilling process may be monitored and information relating to the drilling process can be transmitted to a receiver that is located above the ground. One transmission technique known as electromagnetic telemetry (EM) uses low frequency (few hertz) transmission of information through a geological formation that is being drilled. U.S. Pat. No. 7,252,160 of Dopf et al illustrates a prior art drilling system that has an EM telemetry module, and especially a band gap. The band gap electrically insulates two elements of an antenna. The antenna should be large in order to be effective in the low frequency range.

The information that is to be transmitted above the surface is usually encoded in a time-base pulse scheme or by modulation of a carrier wave.

Some prior art EM tools have only been optimized to operate in open hole conditions where geological formation impedance typically exceeds one ohm.

Recent EM tools should be expected to operate in the low impedance geological formations that exhibit an impedance of much less than one ohm.

Some prior art EM tools have used transformer and inductor-based converters which do not cope well with these low impedance geological formations, producing little output at low efficiency with such loads.

New types of EM tools are needed to produce higher output in these low impedance conditions that work at higher efficiency which allow the EM tools to operate longer downhole.

SUMMARY OF THE INVENTION

According to an embodiment of the invention a drilling system may be provided and it may include a drilling element for drilling a hole in a geological formation; a sensor module arranged to collect information about the drilling; a transmitter that is arranged to receive the information from the sensor module, amplify the information by a super-capacitor amplifier to provide amplified information and to provide the amplified information to a first element and to a second element of an antenna, the first and second elements of the antenna are located at two opposite sides of a band gap; wherein the antenna is arranged to transmit the amplified information via the geological formation; wherein the super-capacitor amplifier may include a plurality of switched capacitor converters, each switched capacitor converter may include a plurality of converter stages, each converter stage may include capacitors and switches that are arranged to perform a current amplification of an input signal; wherein each converter stage is arranged to operate with alternating charge cycles and discharge cycles.

The drilling system may include a cylindrical housing that surrounds the super-capacitor amplifier and a power source that powers the super-capacitor amplifier.

The cylindrical housing may include multiple compartments, wherein at least one compartment is arranged to surround the power source and at least one compartment is arranged to surround at least apportion of the super-capacitor amplifier.

The cylindrical housing may include multiple windows that correspond to the multiple compartments.

The drilling system may include a current limiting circuit for limiting a power consumed by the plurality of switched capacitors.

Each converter stage may include an input switch coupled to a first end of the capacitor, a first output switch having a first end coupled to the first end of the capacitor and a second output switch having a first end coupled to a second end of the capacitor.

Each switched capacitor converter may include a plurality of capacitors, a plurality of first switches, a plurality of first output switches, and a plurality of second output switches; wherein second ends of the first output switches are coupled to each other to form a first output of the switched capacitor converter; wherein second ends of the second output switches are coupled to each other to form a second output of the switched capacitor converter; and wherein the plurality of capacitors and the plurality of first switched are coupled to each other in a serial and an alternating manner to form a sequence, wherein the sequence is coupled between a ground connection and an input of the switched capacitor converter.

The drilling system may include an output network that is coupled between first outputs of the plurality of switched capacitor converters, second outputs of the plurality of switched capacitor converters and between two outputs of the transmitter.

The output network switches in an alternating manner between switched capacitor converters and the two outputs of the transmitter.

The output network couples in an alternating manner the two outputs of the transmitter to either one of (a) a first output of a first switched capacitor converter and a second output of the first switched capacitor converter, and (b) a second output of a second switched capacitor converter and a first output of the second switched capacitor converter.

The first output of the switched capacitor converter is coupled to the first element of the antenna and wherein the second output of the switched capacitor converter is coupled to the second element of the antenna.

According to an embodiment of the invention a method is provided and may include: drilling a hole in a geological formation; collecting information about the drilling;
receiving, by a transmitter, information from the sensor module; amplifying the information by a super-capacitor amplifier to provide amplified information; providing the amplified information to a first element and to a second element of an antenna, the first and second elements of the antenna are located at two opposite sides of a band gap; and transmitting, by the antenna, the amplified information via the geological formation; wherein the super-capacitor amplifier may include a plurality of switched capacitor converters, each switched capacitor converter may include a plurality of converter stages, each converter stage may include capacitors and switches that are arranged to perform a current amplification of an input signal; wherein each converter stage is arranged to operate with alternating charge cycles and discharge cycles.

The super-capacitor amplifier may include a cylindrical housing that surrounds the super-capacitor amplifier and a power source that powers the super-capacitor amplifier.

The cylindrical housing may include multiple compartments, wherein at least one compartment is arranged to surround the power source and at least one compartment is arranged to surround at least a portion of the super-capacitor amplifier.

The cylindrical housing may include multiple windows that correspond to the multiple compartments.

The method may include limiting a power consumed by the plurality of switched capacitors.

The each converter stage may include an input switch coupled to a first end of the capacitor, a first output switch having a first end coupled to the first end of the capacitor and a second output switch having a first end coupled to a second end of the capacitor.

Each switched capacitor converter may include a plurality of capacitors, a plurality of first switches, a plurality of first output switches, and a plurality of second output switches; wherein second ends of the first output switches are coupled to each other to form a first output of the switched capacitor converter; wherein second ends of the second output switches are coupled to each other to form a second output of the switched capacitor converter; and wherein the plurality of capacitors and the plurality of first switched are coupled to each other in a serial and an alternating manner to form a sequence, wherein the sequence is coupled between a ground connection and an input of the switched capacitor converter.

The method may include an output network that is coupled between first outputs of the plurality of switched capacitor converters, second outputs of the plurality of switched capacitor converters and between two outputs of the transmitter.

The method may include switching, by the output network, in an alternating manner, between switched capacitor converters and the two outputs of the transmitter.

The output network couples in an alternating manner, and the two outputs of the transmitter and either one of (a) a first output of a first switched capacitor converter and a second output of the first switched capacitor converter, and (b) a second output of a second switched capacitor converter and a first output of the second switched capacitor converter.

The first output of the switched capacitor converter is coupled to the first element of the antenna and wherein the second output of the switched capacitor converter is coupled to the second element of the antenna.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
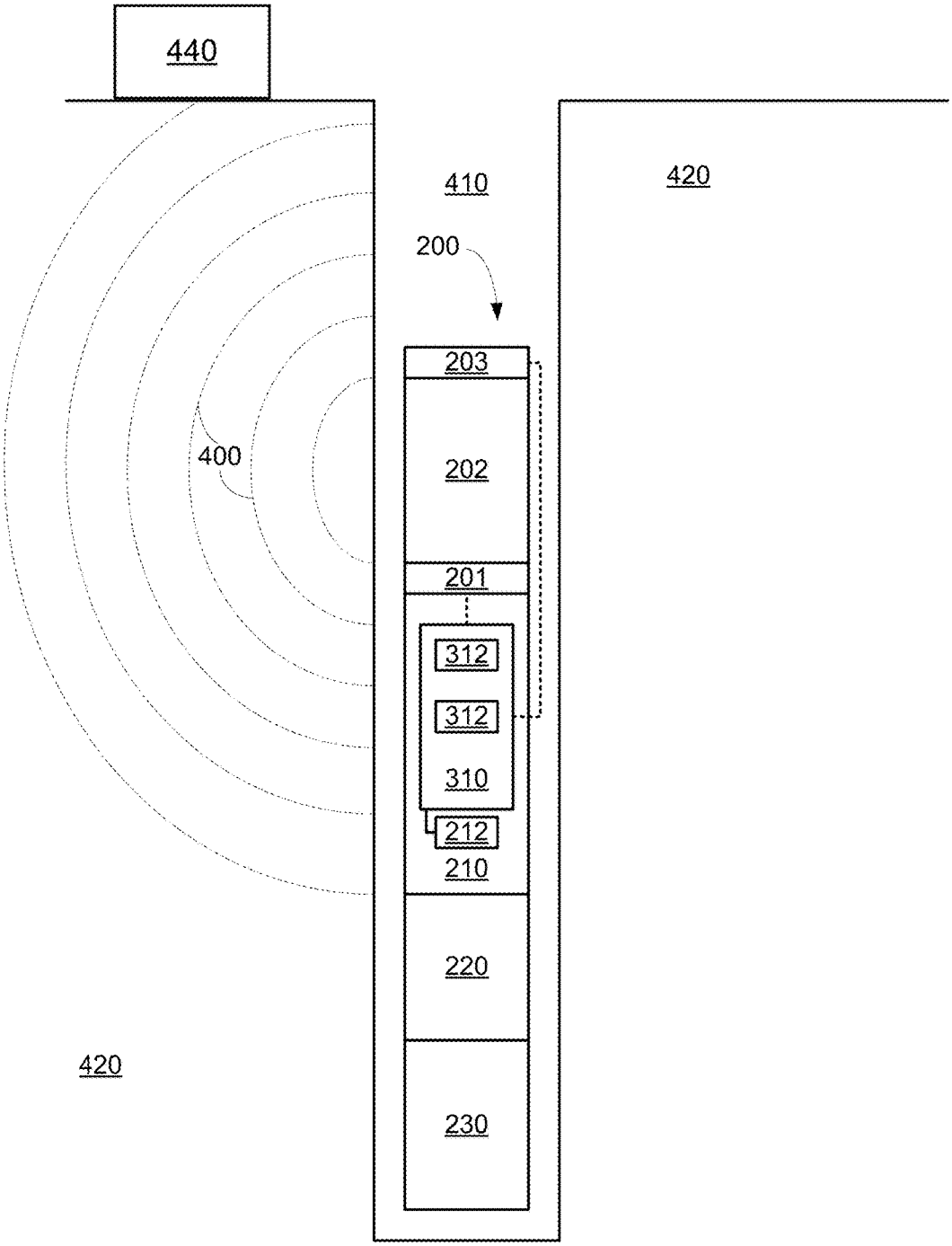
FIG. 1 illustrates a drilling system and its environment according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Considered broadly, a drilling system is provided and may include switched capacitor converters, each of which includes a plurality of converter stages utilizing capacitors to convert input power to a higher current output. These converters operate with alternating charge and discharge cycles to store power from the power source, typically batteries, during a charge cycle, and then deliver power from the converter to the converter output during a discharge cycle. Several converters may be used in the same super-capacitor signal amplifier to provide unipolar, bipolar, or multi-step output.

The charge and discharge cycle can have a period of about 500 micro-seconds although other periods can be applied.

The output signal can have a maximum transmission frequency of 2 kHz, but other frequencies can be used.

The number of bits transmitted by the transmitter can depend on the coding scheme.

An input signal to be amplified by the super-capacitor signal amplifier is obtained from an external source via an input network.

A current limiting circuit is used on the power input side to control the rate of charge of the charge storage and thus ultimately the output power. The current limiting circuit also serves to regulate the current drawn from the power source, typically batteries, so that the battery life is prolonged due to lack of current peaks. Finally, the current limiting circuit provides galvanic isolation between the input power source and the rest of the super-capacitor signal amplifier.

Each stage of each converter is comprised of a capacitance unit and three switches. A capacitance unit consists of a plurality of capacitors arranged in a way as to tolerate the portion of the maximum input voltage to be applied to the converter. One switch is used to control power input into the capacitance unit during a charge cycle. Two more switches are used to control power output to a load from the capacitance unit during the discharge cycle.

A plurality of the stages is connected in such a manner as to series the input sides of the stages with switches and capacitance units in alternation, resulting in a string of capacitance units that can be charged by closing all the input switches and applying power to the top and bottom of the resultant capacitance unit string. In addition, the output sides of the stages are connected such that all of the switches with one leg in direct electrical contact with the higher voltage side of the corresponding capacitor unit have their other leg all connected to a common point deemed the converter output, and the switches with one leg in direct electrical contact with the lower voltage side of the corresponding capacitor unit have their other leg all connected to a common point deemed the converter output return, such that all of the output switches may be closed to discharge all of the capacitance units in parallel into a load connected between the converter output and the converter output return.

An output network consisting of switches and possibly filtering circuitry connects the output of each converter to the super-capacitor signal amplifier output.

For unipolar output, a single converter is used with its output and output return connected as the super-capacitor signal amplifier output and super-capacitor signal amplifier output return.

For bipolar output, two such converters are alternately switched through switches to the EM tool's output. One converter has its output connected to the super-capacitor signal amplifier output, and the converter's output return connected to the super-capacitor signal amplifier output return. The second converter has its output connected to the super-capacitor signal amplifier output return, and the converter's output return connected to the super-capacitor signal amplifier output.

For multi-step output, many such converters are switched through switches to the super-capacitor signal amplifier output with polarities depending on the expected input signal. Filtration may be used to prevent excessive voltage transients from damaging switches in the output network.

A controller is used to control various functions of the super-capacitor signal amplifier. The controller closes and opens switches in the converters to effect charge and discharge cycles. The controller will also ensure adequate dead time between such cycles to prevent damage to the super-capacitor power amplifier from shoot-through and voltage transients. The controller opens and closes switches in the output network to produce an amplified version of the input signal on the super-capacitor signal amplifier output, with dead times to prevent damage to the super-capacitor power amplifier from shoot-through and voltage transients.

FIG. 1 illustrates a drilling system 200 according to an embodiment of the invention. FIG. 1 illustrates the drilling system 200 as drilling a hole 410 in a geological formation 410. Dashed arrows 400 indicate that low frequency radiation is being transmitted through the geological formation 410 and some of it may be received by a receiver 440 that is positioned above the ground.

Drilling system 200 may include: (a) a drilling element 230 for drilling a hole in a geological formation; (b) a sensor module 220 arranged to collect information about the drilling; (c) a band gap 202, (d) an antenna that has a first element 201 and to a second element 203 that are located at two opposite sides of the band gap 202, wherein the antenna is arranged to transmit the amplified information via the geological formation, and (e) a transmitter 210 that is arranged to receive the information from the sensor module, amplify the information by a super-capacitor amplifier 310 to provide amplified information and to provide the amplified information to the first element 201 and to the second element 203 of the antenna.

The super-capacitor amplifier 310 of the transmitter 210 may include a plurality of switched capacitor converters 312, each switched capacitor converter may include a plurality of converter stages. Each converter stage may include capacitors and switches that are arranged to perform a current amplification of an input signal. Each converter stage may be arranged to operate with alternating charge cycles and discharge cycles.

FIG. 1 also illustrates the transmitter 210 as including a power source 212 that may include one or more batteries. Alternatively, the power source can 212 be connected to the transmitter 210 and not belong to the transmitter 210. The system can include one or more power sources.

The drilling system may include a cylindrical housing (denoted 500 in FIGS. 8 and 9) that surrounds the super-capacitor amplifier and a power source that powers the super-capacitor amplifier. The cylindrical housing can be shaped and sized to be included in a piping line that may, in turn, surround most elements (210, 220 and part of 230) of the drilling system.

The cylindrical housing 500 may include multiple compartments, wherein at least one compartment is arranged to surround the power source and at least one compartment is arranged to surround at least a portion of the super-capacitor amplifier. Examples of such compartments are provided in FIGS. 8 and 9.

The cylindrical housing may include multiple windows that correspond to the multiple compartments.

The drilling system 200 may include a current limiting circuit (denoted 46 in FIG. 4) for limiting a power consumed by the plurality of switched capacitors.

Figure 2:
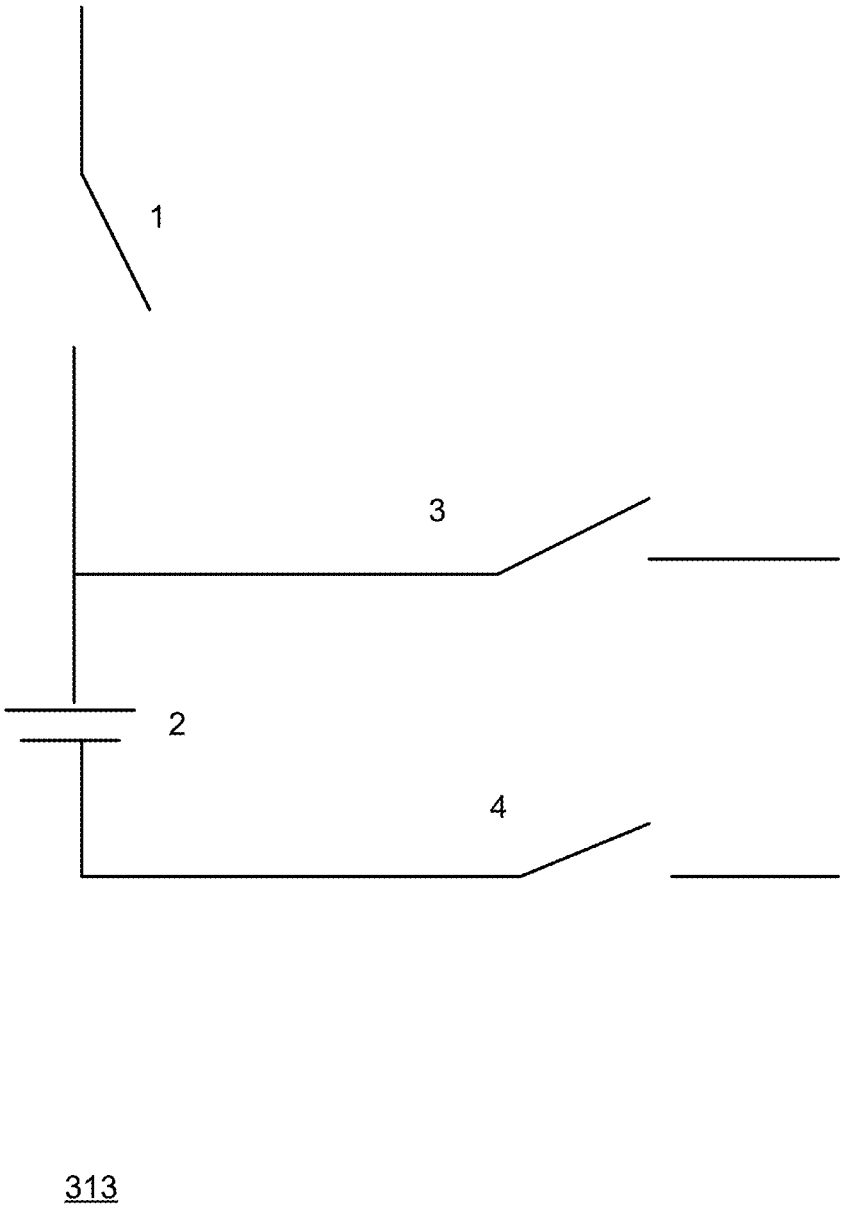
FIG. 2 illustrates a diagrammatic representation of a single converter stage of the super-capacitor signal amplifier according to in an embodiment the invention.

Referring to FIG. 2, a converter stage 313 may include an input switch 1 coupled to a first end of a capacitor 2, a first output switch 3 having a first end coupled to the first end of the capacitor and a second output switch 4 having a first end coupled to a second end of the capacitor.

Figure 3:
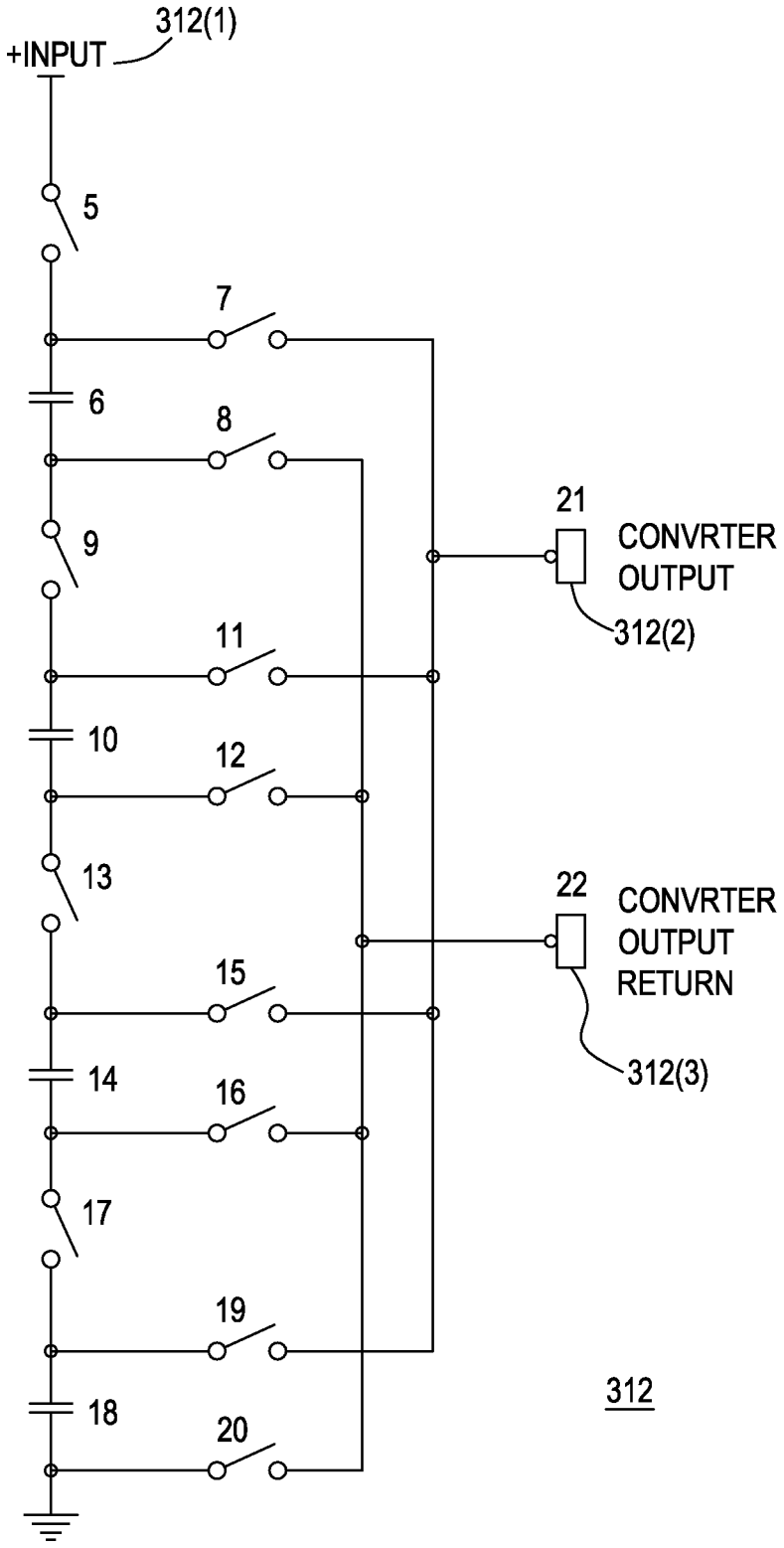
FIG. 3 illustrates a diagrammatic representation of a converter of the super-capacitor signal amplifier according to in an embodiment the invention.

Referring to FIG. 3, a switched capacitor converter 312 may include a plurality of capacitors (6, 10, 14 and 18), a plurality of first switches (5,9,13 and 17), a plurality of first output switches (7,11,15 and 19), and a plurality of second output switches (8,12, 16 and 20). Second ends of the first output switches are coupled to each other to form a first output 312(2) of the switched capacitor converter 312. Second ends of the second output switches are coupled to each other to form a second output 312(3) of the switched capacitor converter 312. The plurality of capacitors and the plurality of first switched are coupled to each other in a serial and an alternating manner to form a sequence, wherein the sequence is coupled between a ground connection and an input 312(1) of the switched capacitor converter.

The drilling system 200 may include an output network (denoted 37 in FIG. 4) that is coupled between first outputs of the plurality of switched capacitor converters (denoted 31 and 32 in FIG. 4), second outputs of the plurality of switched capacitor converters and between two outputs (denoted 41 and 42 in FIG. 4) of the transmitter 210.

The output network 37 switches in an alternating manner between switched capacitor converters 31 and 32 and the two outputs 42 and 43 of the transmitter 210.

The output network 37 may couple in an alternating manner the two outputs of the transmitter to either one of (a) a first output of a first switched capacitor converter and a second output of the first switched capacitor converter, and (b) a second output of a second switched capacitor converter and a first output of the second switched capacitor converter.

Figure 4:
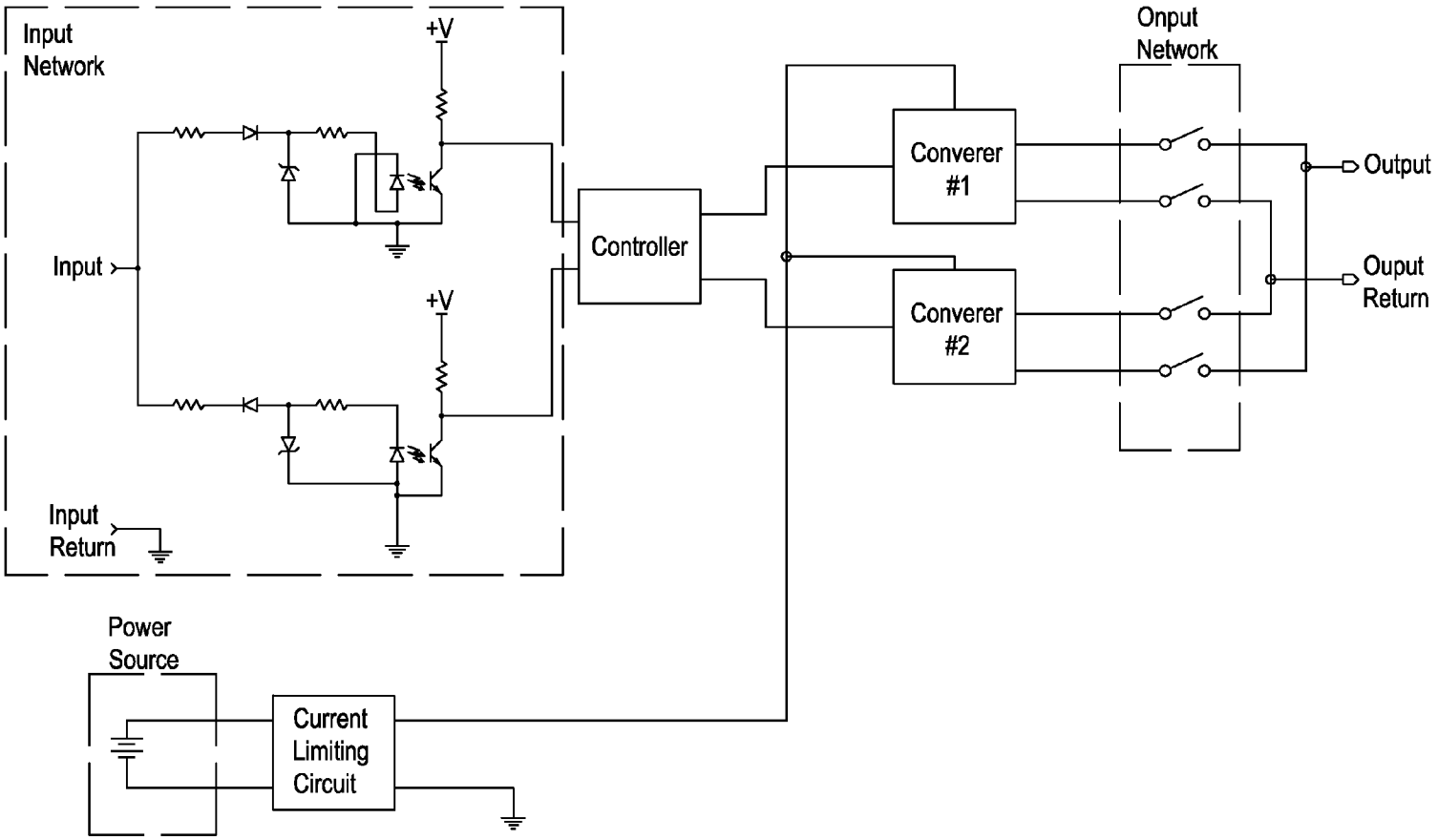
FIG. 4 illustrates the super-capacitor signal amplifier according to an embodiment of the invention.

Referring to FIG. 4, the super-capacitor signal amplifier 310 may include of switched capacitor converters 31 and 32, each of which is comprised of a plurality of converter stages utilizing capacitors to convert input power to a higher current output.

An input signal to be amplified by the super-capacitor signal amplifier is obtained from an external source via an input network 25 on an input 23 and an input return 24.

A current limiting circuit 46 is used on the power input side to control rate of charge of the charge storage. The current limiting circuit also serves to regulate the current drawn from the power source 44 which are batteries 45. The current limiting circuit provides galvanic isolation from the power source 44 to the rest of the super-capacitor signal amplifier.

Each stage of each converter is comprised of a capacitance unit 2 and three switches 3-5. A capacitance unit 2 consists of a plurality of capacitors arranged in a way as to tolerate the portion of the maximum input voltage to be applied to the converter. One switch 1 is used to control power input 47, 48 into the capacitance unit 2 during a charge cycle. Two more switches 2, 3 are used to control power output to the converter output 33-36 from the capacitance unit 2 during the discharge cycle.

A plurality of the stages is connected in such a manner as to series the input sides of the stages with switches 5, 9, 13, 17 and capacitance units 6, 10, 14, 18 in alternation, resulting in a string of capacitance units that can be charged by closing all the input switches and applying power to the top +INPUT and bottom GND of the resultant capacitance unit string. In addition, the output sides of the stages are connected such that all of the switches 7, 11, 15, 19 with one leg in direct electrical contact with the higher voltage side of the corresponding capacitor unit have their other leg all connected to a common point deemed the converter output 21, and the switches 8, 12, 16, 20 with one leg in direct electrical contact with the lower voltage side of the corresponding capacitor unit have their other leg all connected to a common point deemed the converter output return 312(3), such that all of the output switches 7, 8, 11, 12, 15, 16, 19, 20 may be closed to discharge all of the capacitance units 6, 10, 14, 18 in parallel into the converter output 21 and the converter output return 312(3).

An output network 37 may include switches 38-41 connects the output of each converter 31, 32 to the super-capacitor signal amplifier output 42, 43.

A controller 28 is used to control various functions of the super-capacitor signal amplifier. The controller closes and opens switches 5, 7-9, 11-13, 15-17, 19-20 in the converters 31, 32 to effect charge and discharge cycles. The controller will also ensure adequate dead time between such cycles to prevent damage to the super-capacitor power amplifier from shoot-through and voltage transients. The controller opens and closes switches 38-41 in the output network 37 to produce an amplified version of the input signal 23, 24 on the super-capacitor signal amplifier output 42, 43, with dead times to prevent damage to the super-capacitor power amplifier from shoot-through and voltage transients.

Figure 5:
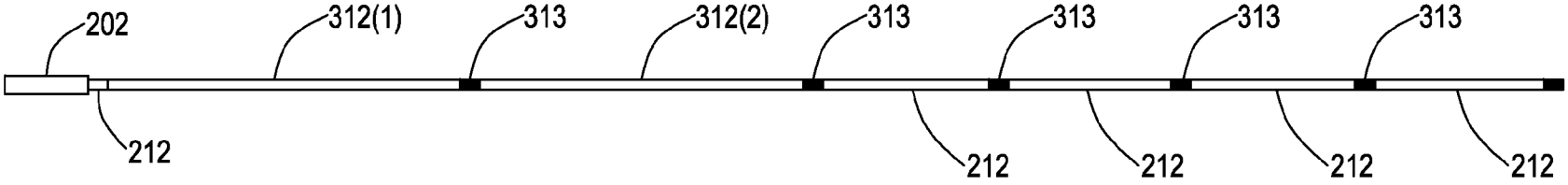
FIG. 5 illustrates a portion of the super-capacitor signal amplifier according to an embodiment of the invention.

FIG. 5 illustrates a layout of a portion of a transmitter 310, according to an embodiment of the invention.

A band gap (also referred to as gap sub) 202 and an antenna portion 201 may be used. For example, the band gap can be a 3⅛" 900-4697B band gap, the antenna head can be a 3⅛" 900-4688A antenna head (although a gap sub and an antenna head of other dimensions can be used).

An upper printed circuit board (PCB) 312(1) may include a first bank of switched capacitors (that provide a positive half cycle output) and the CPU board. A lower PCB 312(2) may include a second bank of switched capacitors that may produce the negative half cycle output. Each PCB may include multiple (for example six) identical chassis (for example—a 19.5" long chassis) that may be attached together with screws end to end to form the whole chassis. These chassis may be separated from each other by interconnecting elements 313.

Figure 6:
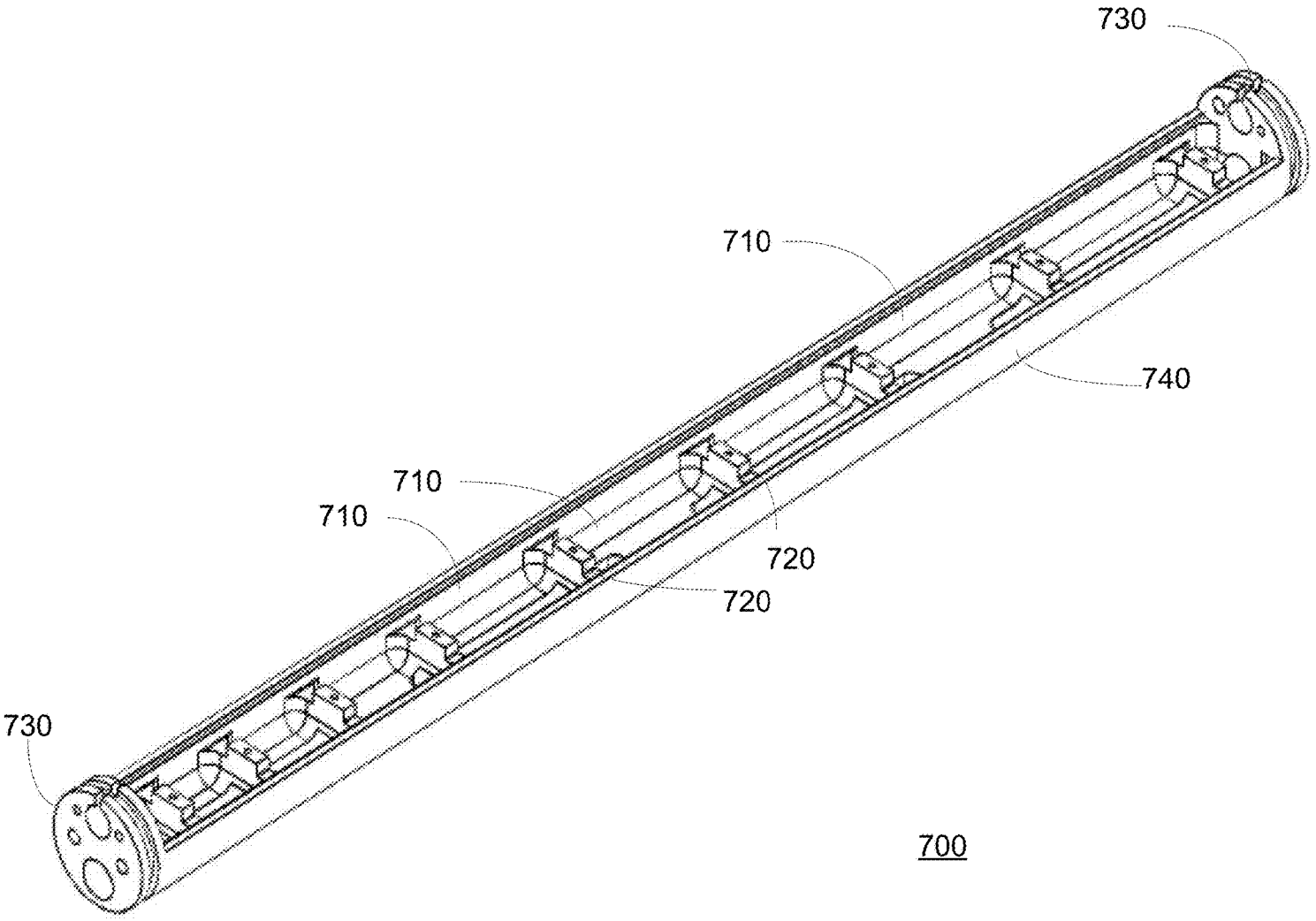
FIG. 6 illustrates a housing of the super-capacitor signal amplifier according to in an embodiment the invention.

FIG. 6 illustrates a housing 700 of the super-capacitor signal amplifier according to an embodiment of the invention. The housing 700 includes an external cylindrical envelope 740, two disk shaped elements 730 that are connected to the opposite ends of the cylindrical envelope 740, and multiple compartments 710 that are separated by spacers 720.

Figure 7:
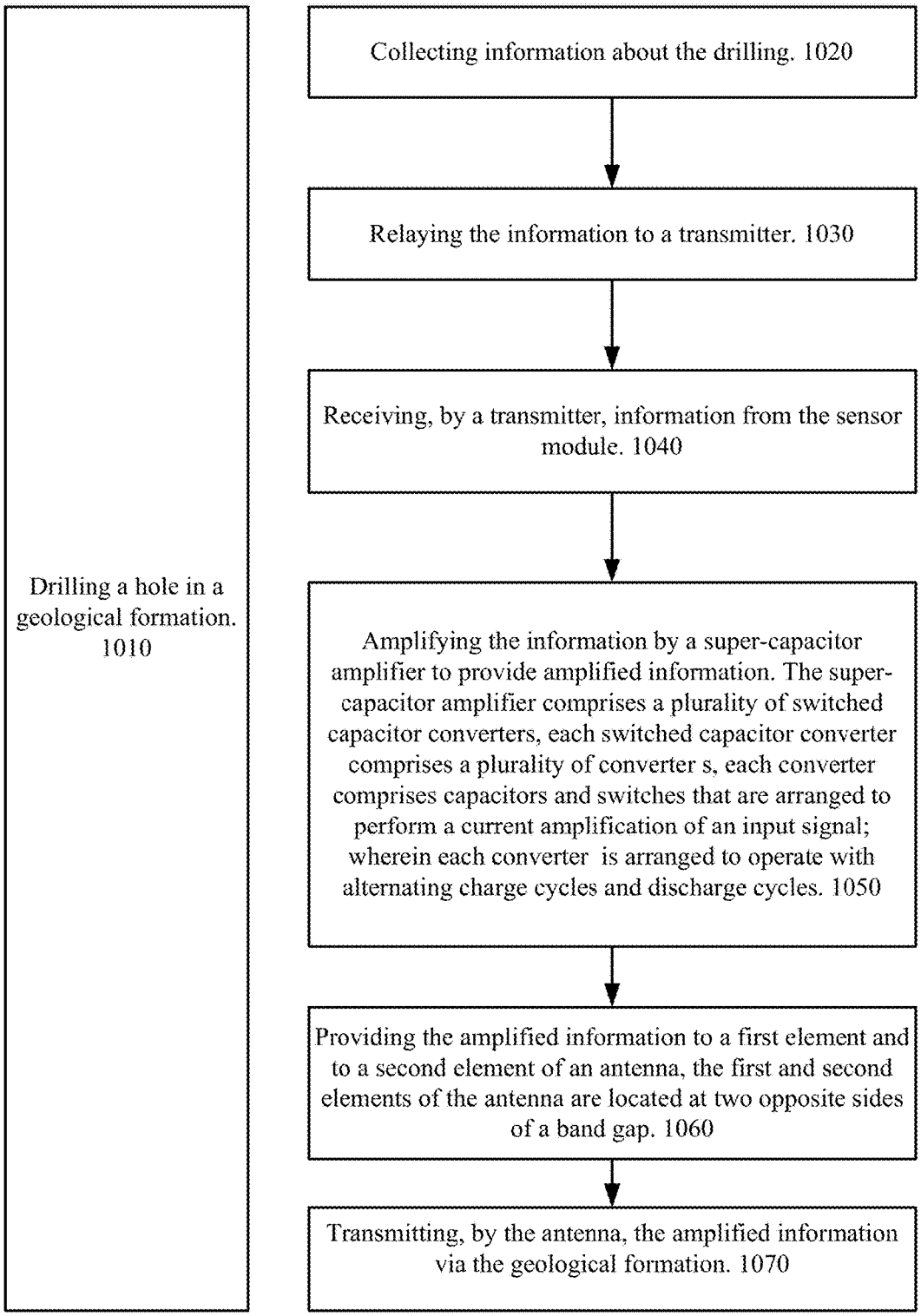
FIG. 7 illustrates a method according to an embodiment of the invention.

FIG. 7 illustrates a method 1000 according to an embodiment of the invention.

Method 1000 includes stages 1010, 1020, 1030, 1040, 1050 and 1060.

Stage 1010 may be executed in parallel to other stages of method 1000. It is noted that some stages can be executed after stage 1010 ends. Multiple iterations of stages 1020-1070 can be executed while stage 1010 is executed.

Stage 1010 includes drilling a hole in a geological formation.

Stage 1020 includes collecting information about the drilling.

Stage 1020 is followed by stage 1030 of relaying the information to a transmitter.

Stage 1030 is followed by stage 1040 of receiving, by a transmitter, information from the sensor module.

Stage 1040 is followed by stage 1050 of amplifying the information by a super-capacitor amplifier to provide amplified information. The super-capacitor amplifier comprises a plurality of switched capacitor converters, each switched capacitor converter comprises a plurality of converter stages, each converter stage comprises capacitors and switches that are arranged to perform a current amplification of an input signal; wherein each converter stage is arranged to operate with alternating charge cycles and discharge cycles. The number of bits that are transmitted can be dependent upon the encoding scheme.

Stage 1050 is followed by stage 1060 of providing the amplified information to a first element and to a second element of an antenna, the first and second elements of the antenna are located at two opposite sides of a band gap. The amplified information can be provided to these two elements in a bipolar manner, in a uni-polar manner, in a differential manner and the like.

Stage 1060 is followed by stage 1070 of transmitting, by the antenna, the amplified information via the geological formation.

Stage 1060 may include switching, by the output network, in an alternating manner (for example—having a cycle of about 500 micro-seconds), between switched capacitor converters and the two outputs of the transmitter.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A drilling system, comprising:

a drilling element for drilling a hole in a geological formation;

a sensor module arranged to collect information about the drilling;

a transmitter that is arranged to receive the information from the sensor module, amplify the information by a super-capacitor amplifier to provide amplified information and to provide the amplified information to a first element and to a second element of an antenna, the first and second elements of the antenna are located at two opposite sides of a band gap;

wherein the antenna is arranged to transmit the amplified information via the geological formation;

wherein the super-capacitor amplifier comprises a plurality of switched capacitor converters, each switched capacitor converter comprises a plurality of converter stages, each converter stage comprises capacitors and switches that are arranged to perform a current amplification of an input signal; and wherein each converter stage is arranged to operate with alternating charge cycles and discharge cycles.

2. The drilling system according to claim 1, comprising a cylindrical housing that surrounds the super-capacitor amplifier and a power source that powers the super-capacitor amplifier.

3. The drilling system according to claim 2, wherein the cylindrical housing comprises multiple compartments, wherein at least one compartment is arranged to surround the power source and at least one compartment is arranged to surround at least a portion of the super-capacitor amplifier.

4. The drilling system according to claim 3, wherein the cylindrical housing comprises multiple windows that correspond to the multiple compartments.

5. The drilling system according to claim 1, comprises a current limiting circuit for limiting a power consumed by the plurality of switched capacitors.

6. The drilling system according to claim 1, wherein each converter stage comprises an input switch coupled to a first end of the capacitor, a first output switch having a first end coupled to the first end of the capacitor and a second output switch having a first end coupled to a second end of the capacitor.

7. The drilling system according to claim 6, wherein each switched capacitor converter comprises a plurality of capacitors, a plurality of first switches, a plurality of first output switches, and a plurality of second output switches; wherein second ends of the first output switches are coupled to each other to form a first output of the switched capacitor converter; wherein second ends of the second output switches are coupled to each other to form a second output of the switched capacitor converter; and wherein the plurality of capacitors and the plurality of first switched are coupled to each other in a serial and an alternating manner to form a sequence, wherein the sequence is coupled between a ground connection and an input of the switched capacitor converter.

8. The drilling system according to claim 7, comprising an output network that is coupled between first outputs of the plurality of switched capacitor converters, second outputs of the plurality of switched capacitor converters and between two outputs of the transmitter.

9. The drilling system according to claim 8, wherein the output network switches in an alternating manner between switched capacitor converts and the two outputs of the transmitter.

10. The drilling system according to claim 8, wherein the output network couples in an alternating manner the two outputs of the transmitter to either one of (a) a first output of a first switched capacitor converter and a second output of the first switched capacitor converter, and (b) a second output of a second switched capacitor converter and a first output of the second switched capacitor converter.

11. The drilling system according to claim 7, wherein the first output of the switched capacitor converter is coupled to the first element of the antenna and wherein the second output of the switched capacitor converter is coupled to the second element of the antenna.

12. The drilling system according to claim 1, wherein the super capacitor amplifier comprises an upper printed circuit board (PCB) that is coupled to a first bank of switched capacitors that are arranged to provide a positive half cycle output and a lower PCB that is coupled to a second bank of switched capacitors that are arranged to provide a negative half cycle output.

13. A method, comprising:

drilling a hole in a geological formation;

collecting information about the drilling;

receiving, by a transmitter, information from the sensor module;

amplifying the information by a super-capacitor amplifier to provide amplified information;

providing the amplified information to a first element and to a second element of an antenna, the first and second elements of the antenna are located at two opposite sides of a band gap;

transmitting, by the antenna, the amplified information via the geological formation;

wherein the super-capacitor amplifier comprises a plurality of switched capacitor converters, each switched capacitor converter comprises a plurality of converter stages, each converter stage comprises capacitors and switches that are arranged to perform a current amplification of an input signal; wherein each converter stage is arranged to operate with alternating charge cycles and discharge cycles.

14. The method according to claim 13, wherein the super-capacitor amplifier comprises a cylindrical housing that surrounds the super-capacitor amplifier and a power source that powers the super-capacitor amplifier.

15. The method according to claim 14, wherein the cylindrical housing comprises multiple compartments, wherein at least one compartment is arranged to surround the power source and at least one compartment is arranged to surround at least a portion of the super-capacitor amplifier.

16. The method according to claim 15, wherein the cylindrical housing comprises multiple windows that correspond to the multiple compartments.

17. The method according to claim 13, comprising limiting a power consumed by the plurality of switched capacitors.

18. The method according to claim 13, wherein each converter stage comprises an input switch coupled to a first end of the capacitor, a first output switch having a first end coupled to the first end of the capacitor and a second output switch having a first end coupled to a second end of the capacitor.

19. The method according to claim 18, wherein each switched capacitor converter comprises a plurality of capacitors, a plurality of first switches, a plurality of first output switches, and a plurality of second output switches; wherein second ends of the first output switches are coupled to each other to form a first output of the switched capacitor converter; wherein second ends of the second output switches are coupled to each other to form a second output of the switched capacitor converter; and wherein the plurality of capacitors and the plurality of first switched are coupled to each other in a serial and an alternating manner to form a sequence, wherein the sequence is coupled between a ground connection and an input of the switched capacitor converter.

20. The method according to claim 19, comprising an output network that is coupled between first outputs of the plurality of switched capacitor converters, second outputs of the plurality of switched capacitor converters and between two outputs of the transmitter.

21. The method according to claim 20, comprising, switching, by the output network, in an alternating manner, between switched capacitor converters and the two outputs of the transmitter.

22. The method according to claim 20, wherein the output network couples in an alternating manner, and the two outputs of the transmitter and either one of (a) a first output of a first switched capacitor converter and a second output of the first switched capacitor converter, and (b) a second output of a second switched capacitor converter and a first output of the second switched capacitor converter.

23. The method according to claim 19, wherein the first output of the switched capacitor converter is coupled to the first element of the antenna and wherein the second output of the switched capacitor converter is coupled to the second element of the antenna.

24. The method according to claim 13, wherein the super capacitor amplifier comprises an upper printed circuit board (PCB) that is coupled to a first bank of switched capacitors that are arranged to provide a positive half cycle output and a lower PCB that is coupled to a second bank of switched capacitors that are arranged to provide a negative half cycle output.

* * * * *